US012654279B2

(12) United States Patent
Ogane et al.

(10) Patent No.: US 12,654,279 B2
(45) Date of Patent: Jun. 16, 2026

(54) PROCESSING APPARATUS

(71) Applicant: DISCO CORPORATION, Tokyo (JP)

(72) Inventors: Tomoya Ogane, Tokyo (JP); Miki Yoshida, Tokyo (JP)

(73) Assignee: DISCO CORPORATION, Tokyo (JP)

( * ) Notice: Subject to any disclaimer, the term of this patent is extended or adjusted under 35 U.S.C. 154(b) by 314 days.

(21) Appl. No.: 18/446,655

(22) Filed: Aug. 9, 2023

(65) Prior Publication Data

US 2024/0066659 A1 Feb. 29, 2024

(30) Foreign Application Priority Data

Aug. 29, 2022 (JP) ..... 2022-135891

(51) Int. Cl.

| | |
|---|---|
| ***B24B 37/015*** | (2012.01) |
| ***B24B 41/06*** | (2012.01) |
| ***B24B 49/14*** | (2006.01) |
| ***B24D 7/10*** | (2006.01) |

(52) U.S. Cl.

CPC ..... *B24B 37/015* (2013.01); *B24B 41/06* (2013.01); *B24B 49/14* (2013.01); *B24D 7/10* (2013.01)

(58) Field of Classification Search

CPC ..... B24B 37/015; B24B 7/10; B24B 55/02; B24B 55/03; B24B 55/12; B24B 49/14; B24B 41/00; B24B 41/002; B24B 41/005; B24B 41/007; B24B 41/02; B24B 41/04; B24B 41/047; B24B 41/06; B23Q 11/003; B23Q 11/0007

See application file for complete search history.

(56) References Cited

U.S. PATENT DOCUMENTS

2016/0076794 A1* 3/2016 Saito ..... B23Q 11/146 62/6

FOREIGN PATENT DOCUMENTS

| | | | | |
|---|---|---|---|---|
| JP | 2007127343 A | | 5/2007 | |
| JP | 2009202295 A | * | 9/2009 | ..... C23C 16/463 |
| JP | 2018036406 A | | 3/2018 | |
| WO | WO-2004079805 A1 | * | 9/2004 | ..... C23C 16/463 |

OTHER PUBLICATIONS

Office Action issued by the Japanese Patent Office in corresponding JP Patent Application No. 2022-135891, dated Mar. 31, 2026.

* cited by examiner

*Primary Examiner* — Carlos A Rivera
(74) *Attorney, Agent, or Firm* — GREER BURNS & CRAIN, LTD.

(57) ABSTRACT

A processing apparatus includes a holding table and a processing unit. The processing unit includes a spindle unit having a spindle and a housing in which the spindle is rotatably supported. The processing unit is connected to a spindle temperature adjusting unit for adjusting the temperature of the spindle unit to a predetermined temperature. The spindle temperature adjusting unit includes a circulation route through which a cooling liquid to be introduced into the housing circulates and a heat exchanger connected to the circulation route. The heat exchanger is supplied with a processing liquid, to lower the temperature of the cooling liquid flowing in the circulation route with the processing liquid and increase the temperature of the processing liquid with the cooling liquid.

10 Claims, 5 Drawing Sheets

PROCESSING APPARATUS

BACKGROUND OF THE INVENTION

Field of the Invention

The present invention relates to a processing apparatus including a holding table for holding a workpiece thereon and a processing unit for processing the workpiece on the holding table, in which a cooling liquid circulates to keep particular components at a predetermined temperature.

Description of the Related Art

Various processing apparatuses such as cutting apparatuses, grinding apparatuses, and polishing apparatuses have been known in the art as apparatuses for processing workpieces such as semiconductor wafers. In order for such processing apparatuses to repeatedly process workpieces with minimum processing fluctuations, it is important that the temperature of a processing unit and the temperature of a workpiece be controlled to a nicety. If the temperatures of the processing unit, etc., are not kept constant when the processing unit is processing two or more workpieces, then the processing unit may not be able to process the workpiece to desired standards. Further, if the temperatures of the processing unit, etc., vary while the processing unit is processing a workpiece, then the processing unit may not be able to process the workpiece to desired standards. The processing unit includes, for example, a processing tool for processing a workpiece in contact therewith while in rotation, a spindle as a rotational shaft for rotating the processing tool mounted thereon about its own axis, and a rotary actuator such as an electric motor for rotating the spindle and hence the processing tool. When the processing unit is in operation, the spindle is rotated by the electric motor. Since the spindle is heated during its rotation, the spindle suffers thermal expansion, tending to change the manner in which the workpiece is processed by the processing tool.

To alleviate the above drawback, the processing unit is supplied with a cooling liquid, i.e., cooling water, adjusted to a predetermined temperature in order to keep the processing unit at a constant temperature and prevent the spindle from being thermally expanded. The processing apparatuses have a circulation route through which the cooling liquid circulates, and a cooling unit disposed in the circulation route to cool the cooling liquid. The cooling liquid which has been used to cool the spindle and whose temperature has risen is cooled by the cooling unit and is then supplied to the spindle. In addition, the processing apparatuses continuously eject a processing liquid, i.e., processing water, such as pure water to the workpiece and the processing tool of the processing unit to quickly remove swarf and heat of friction produced from the workpiece being processed. Since the processing liquid is continuously brought into contact with the workpiece, etc., the temperatures of the workpiece, etc., are affected by the temperature of the processing liquid. As undue thermal expansion and shrinkage of the workpiece, etc., prevent the workpiece from being processed to desired standards, the temperature of the processing liquid is also controlled. One known processing apparatus controls the temperatures of a cooling liquid and a processing liquid and supplies the temperature-controlled cooling and processing liquids to certain areas where the liquids are used to serve their purposes (see JP 2018-36406A).

SUMMARY OF THE INVENTION

A processing liquid supply source for supplying a processing liquid such as pure water is connected to a processing apparatus. The processing apparatus may be used in a geographical region where the temperature of the processing liquid supplied from the processing liquid supply source connected to the processing apparatus is extremely low. If the processing liquid whose temperature is extremely low is supplied to the processing tool and the workpiece, then the processing tool and the workpiece are caused to suffer thermal shrinkage. Heretofore, one solution has been to incorporate a heater in the processing apparatus to heat the processing liquid supplied from the processing liquid supply source to a desired temperature. However, it is highly costly to install and operate the heater. In addition, the processing apparatus makes its efficiency low by using the cooling unit to reuse the cooling liquid that has been used, and heating the processing liquid supplied from the processing liquid supply source before the processing liquid is ejected to the workpiece and the processing tool.

It is therefore an object of the present invention to provide a processing apparatus that is capable of efficiently supplying a cooling liquid at a predetermined temperature to certain components.

In accordance with an aspect of the present invention, there is provided a processing apparatus including a holding table for holding a workpiece thereon, a processing unit for processing the workpiece held on the holding table, and a controller. The processing unit includes a spindle unit having a spindle with a processing tool mounted thereon, a housing in which the spindle is rotatably supported, and an electric motor for rotating the spindle about its central axis. The processing apparatus further includes a spindle temperature adjusting unit for cooling the spindle of the spindle unit to adjust a temperature of the spindle to a predetermined temperature, the processing unit being connected to the spindle temperature adjusting unit. The spindle temperature adjusting unit includes a circulation route through which a cooling liquid to be introduced into the housing of the spindle unit and discharged from the housing circulates, a pump connected to the circulation route and configured to circulate the cooling liquid through the circulation route, a first heat exchanger connected to the circulation route, and a first temperature sensor connected to the circulation route upstream of the housing and configured to measure a temperature of the cooling liquid that is to flow into the housing. The first heat exchanger is supplied with a processing liquid supplied from a processing liquid supply source, to lower the temperature of the cooling liquid flowing in the circulation route with the processing liquid and increase a temperature of the processing liquid with the cooling liquid.

Preferably, the spindle temperature adjusting unit further includes a cooling unit connected to the circulation route and configured to cool the cooling liquid, and the controller adjusts an output level of the cooling unit by referring to the temperature of the cooling liquid measured by the first temperature sensor.

Preferably, the spindle temperature adjusting unit further includes a bypass route connected to the circulation route parallel to the first heat exchanger, and a valve connected to the bypass route and configured to adjust a rate at which the cooling liquid flows in the bypass route. The controller adjusts a degree of opening of the valve by referring to the temperature of the cooling liquid measured by the first temperature sensor.

Further preferably, the processing apparatus further includes a supply route in which the processing liquid flows from the first heat exchanger, in which the processing liquid that is supplied from the processing liquid supply source to the first heat exchanger and that has a temperature increased by the first heat exchanger is supplied through the supply route to the workpiece held on the holding table or the processing tool.

More preferably, the processing apparatus further includes a heating unit connected to the supply route and configured to heat the processing liquid flowing in the supply route, and a second temperature sensor connected to the supply route downstream of the heating unit and configured to measure the temperature of the processing liquid flowing in the supply route.

Preferably, the processing apparatus further includes a second heat exchanger connected to the supply route, in which the processing liquid that has been supplied to the workpiece held on the holding table or the processing tool through the supply route and that has been used is introduced into the second heat exchanger, and the second heat exchanger increases the temperature of the processing liquid flowing in the supply route with the used processing liquid.

In accordance with another aspect of the present invention, there is provided a processing apparatus including a holding table for holding a workpiece thereon and a processing unit having a processing tool for processing the workpiece held on the holding table. The processing apparatus includes a supply route in which a processing liquid supplied from a processing liquid supply source flows to the workpiece held on the holding table or the processing tool, and a heat exchanger connected to the supply route. The processing liquid that has been supplied to the workpiece held on the holding table or the processing tool through the supply route and that has been used is introduced into the heat exchanger, and the heat exchanger causes a temperature of the processing liquid flowing in the supply route to become closer to a temperature of the used processing liquid.

Preferably, the processing apparatus further includes a heating unit connected to the supply route and configured to heat the processing liquid flowing in the supply route and/or a cooling unit connected to the supply route and configured to cool the processing liquid flowing in the supply route, and a temperature sensor connected to the supply route downstream of the heat exchanger and configured to measure the temperature of the processing liquid flowing in the supply route.

The processing apparatus according to the aspect of the present invention includes the first heat exchanger connected to the circulation route in which the cooling liquid that is used to cool the spindle unit and thus has its temperature increased flows. The first heat exchanger is supplied with the processing liquid from the processing liquid supply source. In the first heat exchanger, the temperature of the cooling liquid flowing in the circulation route is lowered by the processing liquid, and the temperature of the processing liquid is increased by the cooling liquid. In other words, the first heat exchanger performs a heat exchange between the cooling liquid and the processing liquid. When the temperature of the cooling liquid whose temperature has been raised is lowered by the first heat exchanger, the cooling liquid can easily be reused. On the other hand, when the temperature of the processing liquid supplied from the processing liquid supply source is increased, the processing liquid can easily be supplied to the processing tool, etc. At least, the cooling liquid whose temperature has been raised can easily be adjusted to a temperature suitable for reusing the cooling liquid, and the low temperature of the processing liquid can easily be adjusted to a temperature suitable for using the processing liquid, compared with the case where the first heat exchanger is not used. Accordingly, the cost required to adjust the temperatures of the cooling liquid and the processing liquid can be reduced.

According to the aspects of the present invention, therefore, the processing apparatus is able to efficiently supply the cooling liquid at the predetermined temperature to various components thereof.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
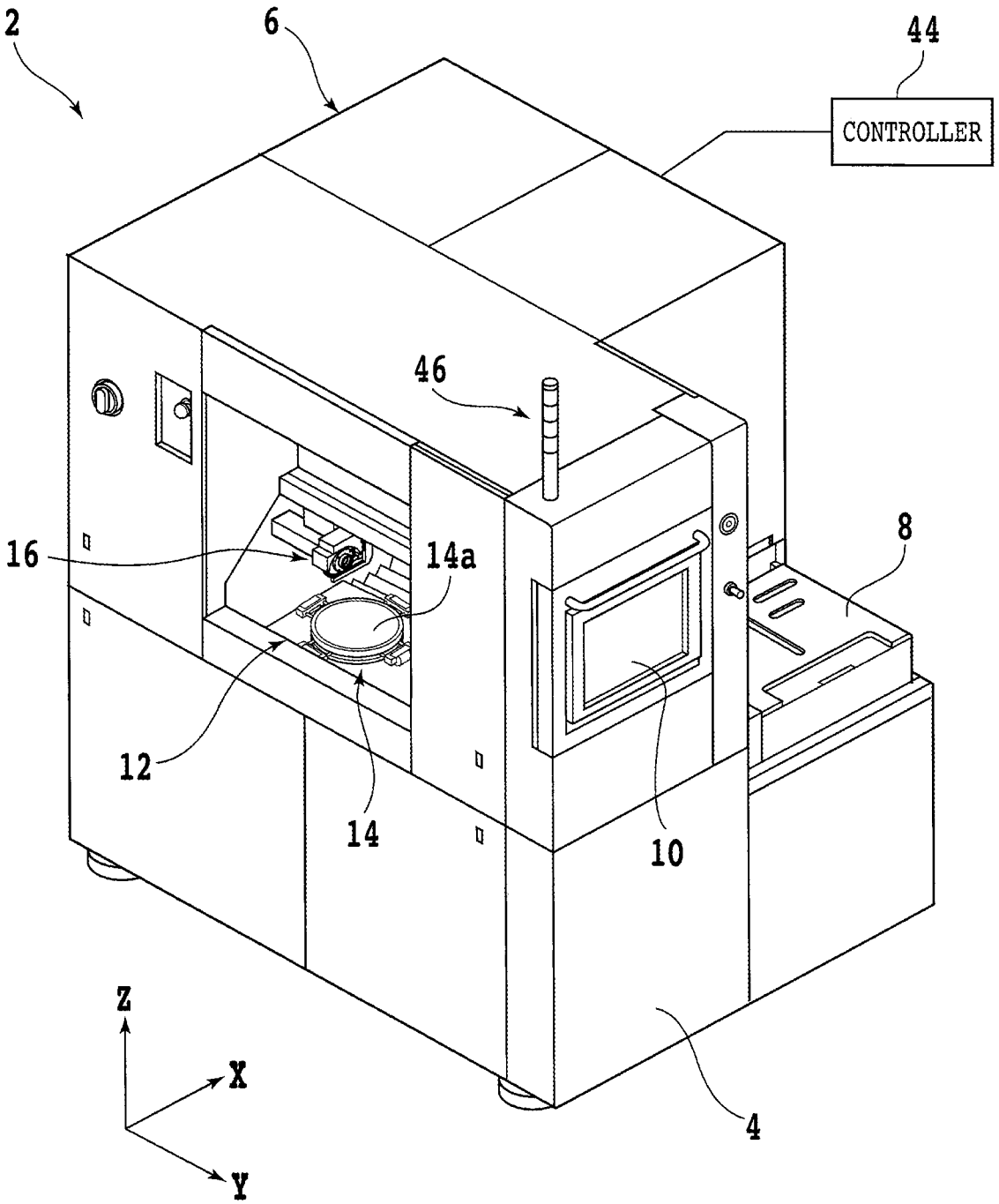
FIG. 1 is a perspective view schematically illustrating a processing apparatus according to an embodiment of the present invention.

A processing apparatus according to an embodiment of the present invention will be described in detail below with reference to the accompanying drawings. The processing apparatus is installed in a factory where semiconductor device chips are manufactured, and processes workpieces such as semiconductor wafers. The processing apparatus may be in the form of a cutting apparatus, a grinding apparatus, a polishing apparatus, or the like. The processing apparatus includes a processing unit having a processing tool, a spindle on which the processing tool is mounted, and an electric motor for rotating the spindle about its central axis, and a holding table known as a chuck table for holding a workpiece to be processed by the processing unit.

Like or corresponding parts are denoted by like or corresponding reference characters throughout views.

Figure 2:
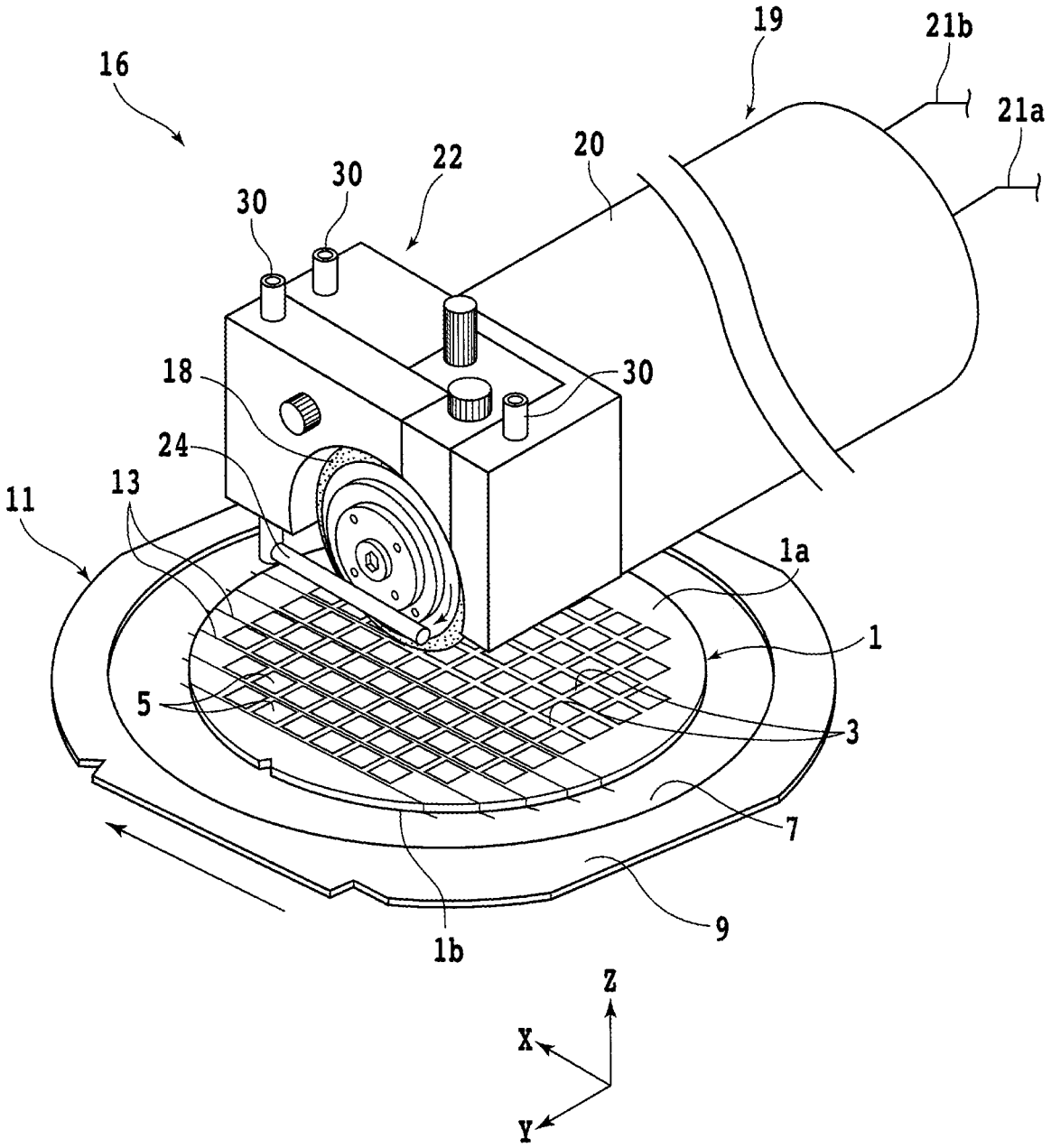
FIG. 2 is a perspective view schematically illustrating a workpiece that is processed by a processing tool of the processing apparatus while being supplied with a processing liquid.

FIG. 2 schematically illustrates, in perspective, a workpiece 1 that is being processed by the processing unit of the processing apparatus. The workpiece 1 will first be described below. The workpiece 1 is a wafer made of silicon (Si), silicon carbide (SiC), gallium nitride (GaN), gallium arsenide (GaAs), or another material such as a semiconductor, for example. Alternatively, the workpiece 1 may be a wafer made of a double oxide such as lithium tantalate (LT) or lithium niobate (LN). Further alternatively, the workpiece 1 may be a substrate shaped as a substantially circular plate made of such a material as sapphire, glass, or quartz. The glass may be alkali glass, non-alkali glass, soda-lime glass, lead glass, borosilicate glass, quartz glass, or the like. Still further alternatively, the workpiece 1 may be a packaged substrate in which a plurality of device chips are arranged in a matrix and encapsulated by resin. The workpiece 1 will hereinafter be described as a semiconductor wafer by way of example, though the workpiece 1 is by no means limited to a semiconductor wafer according to the present invention.

The workpiece 1 has a face side 1*a*, which faces upwardly in FIG. 2, that includes a plurality of areas demarcated by a grid of projected dicing lines 3 established thereon. Devices 5 such as integrated circuits (ICs) or large-scale integrated (LSI) circuits are constructed in the respective areas demarcated on the face side 1*a* by the projected dicing lines 3. The devices 5 are not limited to any particular types, numbers, layouts, etc. The workpiece 1 is processed along the projected dicing lines 3 to form processed marks 13 such as dividing grooves therein, and divided along the processed marks 13 into individual device chips including the respective devices 5. Before the workpiece 1 is divided, the workpiece 1 is thinned down by being ground on a reverse side 1*b* thereof that is opposite the face side 1*a* and faces downwardly in FIG. 2. Then, the reverse side 1*b* of the workpiece 1 is planarized by being polished. Thereafter, the workpiece 1 is divided to produce thin device chips. As described above, the workpiece 1 with the devices 5 included in the face side 1*a* is processed by various processing apparatuses.

When the workpiece 1 is introduced into a processing apparatus, an adhesive tape 7 affixed to a ring frame 9 made of metal or the like in such a manner as to cover an opening of the ring frame 9 has been affixed to the reverse side 1*b* of the workpiece 1. The workpiece 1, the adhesive tape 7, and the ring frame 9 that are integrally combined with each other are handled as a frame unit 11. The frame unit 11 is introduced into the processing apparatus and is then processed, e.g., divided, thereby. The device chips produced from the workpiece 1 when the workpiece 1 is divided remain supported on the adhesive tape 7, and are subsequently picked up from the adhesive tape 7.

The processing apparatus according to the present embodiment will be described as a cutting apparatus for cutting the workpiece 1. Although the cutting apparatus will be described as an illustrative example of the processing apparatus, the processing apparatus according to the present invention is not limited to a cutting apparatus. FIG. 1 schematically illustrates, in perspective, the cutting apparatus as an illustrative example of the processing apparatus, denoted by 2, according to the present embodiment.

The processing apparatus 2 includes a base 4 supporting various components thereon and a casing 6 covering the components supported on the base 4. A cassette support table 8 is disposed on a corner of the base 4 that is not covered by the casing 6. A cassette, not illustrated, that stores a plurality of workpieces 1 therein is to be placed on the cassette support table 8.

A display 10 with a touch panel is mounted on an outer surface of a side wall of the casing 6 of the processing apparatus 2. The display 10 displays various items of information and a control screen. An operator of the processing apparatus 2 can enter various commands into the processing apparatus 2 by touching the touch panel at various positions on the displayed control screen. Therefore, the display 10 with the touch panel functions as an input unit, i.e., an input interface, used to enter various commands and also functions as a display unit for displaying various items of information. The processing apparatus 2 also includes a signaling unit for issuing a warning to the operator in a case where the processing apparatus 2 malfunctions or is in a situation that the operator should be informed of. The display 10 with the touch panel can also function as the signaling unit by displaying a warning screen. In addition, the processing apparatus 2 includes a warning lamp unit 46 having a plurality of lamps in various colors that can be used as the signaling unit. The warning lamp unit 46 is able to give various items of information to the operator by selectively turning on the lamps to emit different color lights.

Figure 3:
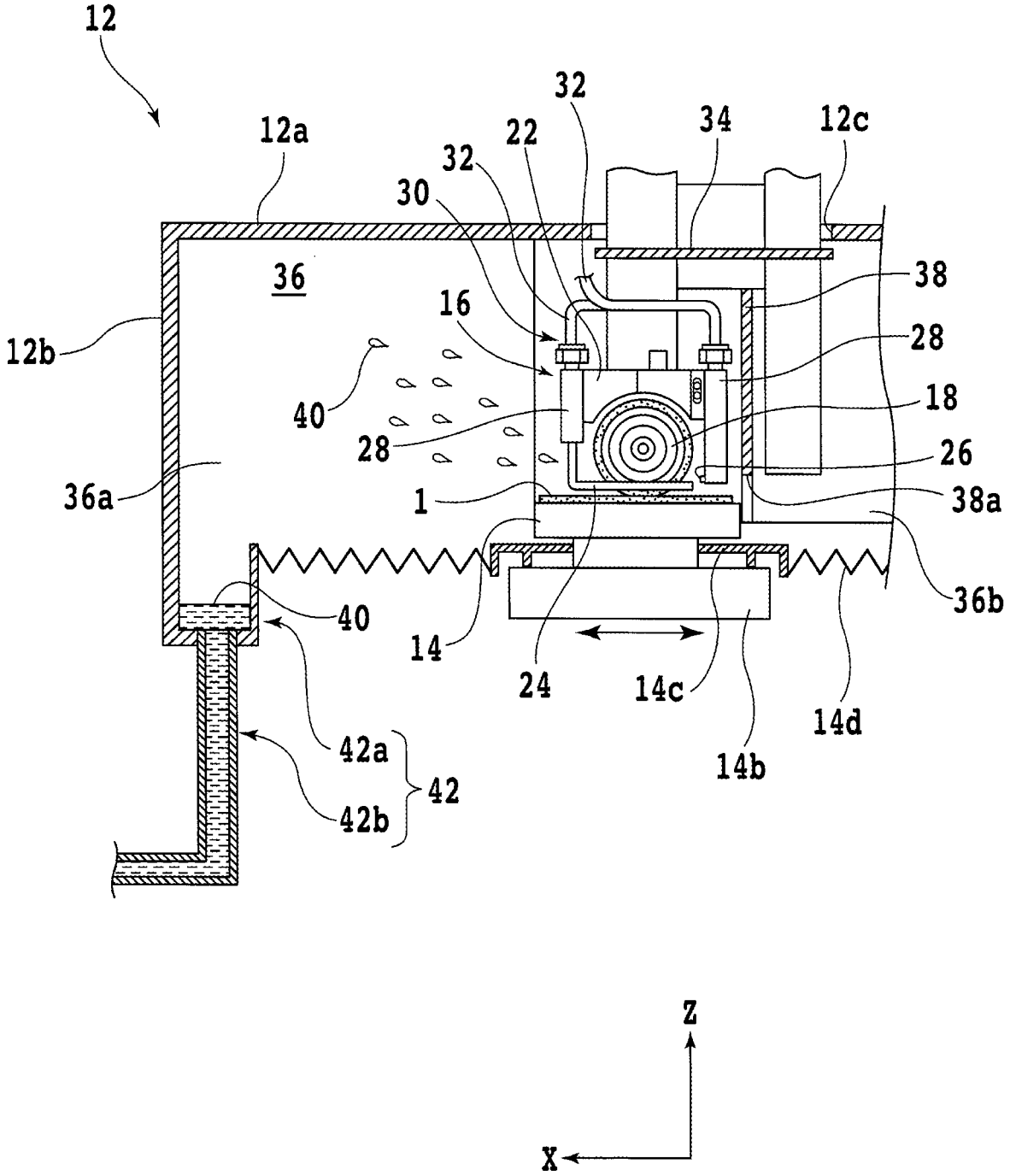
FIG. 3 is a cross-sectional view schematically illustrating, partly in side elevation, a processing chamber where the processing liquid is used, retrieved, and discharged.

The casing 6 of the processing apparatus 2 includes a processing chamber 12 therein. The processing apparatus 2 processes, i.e., cuts, the workpiece 1 in the processing chamber 12. The processing chamber 12 houses therein a holding table, i.e., a chuck table, 14 for holding the workpiece 1 under suction thereon. FIG. 3 schematically illustrates the processing chamber 12 in cross section, partly in side elevation. As illustrated in FIG. 3, the processing chamber 12 is shaped as a rectangular parallelepiped covering the holding table 14 and a processing unit 16, and has an inner space as a processing space 36 in which the workpiece 1 is processed. The holding table 14 and the processing unit 16 are accommodated in the processing space 36 in the processing chamber 12. The processing chamber 12 has a horizontal upper wall 12*a* having a substantially rectangular shape as viewed in plan and extending horizontally along an X-axis and a side wall 12*b* being joined to the upper wall 12*a* and extending vertically along a Z-axis. The upper wall 12*a* has an opening 12*c* defined therein that is large enough to receive a support structure for the processing unit 16 inserted therein.

The holding table 14 is supported on an X-axis movable table 14*b* covered with a table cover 14*c*. The X-axis movable table 14*b* is movable in processing feed directions along the X-axis by a processing feed unit, i.e., an X-axis moving mechanism, not illustrated. When the X-axis movable table 14*b* is moved in one of the processing feed directions, the holding table 14 supported thereon is also moved, i.e., processing-fed, along the X-axis. A dust-resistant and drip-resistant cover 14*d* shaped as bellows expandable and contractible along the X-axis is joined to front and rear ends of the table cover 14*c*. Swarf produced from the workpiece 1 and processing liquid droplets scattered in the processing chamber 12 fall on and received by the dust-resistant and drip-resistant cover 14*d*. Therefore, the processing feed unit that is disposed below the dust-resistant and drip-resistant cover 14*d* is protected from swarf and processing liquid droplets by the dust-resistant and drip-resistant cover 14*d*.

The holding table 14 has a porous upper surface 14*a* (see FIG. 1) acting as a holding surface for holding the workpiece 1 under suction thereon. The upper surface 14*a* lies generally parallel to the X-axis and a Y-axis (see FIG. 1) perpendicular to the X-axis, and is fluidly connected to a suction source, not illustrated, such as an ejector through a suction channel, not illustrated, defined in the holding table 14. The holding table 14 is coupled to a rotary actuator, not illustrated, such as an electric motor, and is rotatable thereby about its central axis extending vertically parallel to the Z-axis.

The processing chamber 12 houses therein one or more processing units, i.e., cutting units, 16 for processing, i.e., cutting, the workpiece 1 held on the holding table 14. The processing unit 16 or each of the processing units 16 is supported on a lifting and lowering unit, i.e., a Z-axis moving mechanism, not illustrated, and an indexing feed unit, i.e., a Y-axis moving mechanism, not illustrated, and can be moved vertically along the Z-axis and in an indexing feed direction along the Y-axis.

FIG. 2 also schematically illustrates the processing unit 16 or each of the processing units 16 in perspective. As illustrated in FIG. 2, the processing unit 16 includes an annular cutting blade 18 as a processing tool for processing, i.e., cutting, the workpiece 1. The processing unit 16 includes a spindle unit 19 having a spindle, not illustrated, on which the cutting blade 18 is mounted, a housing 20 in which the spindle is rotatably supported, and a rotary actuator, not illustrated, such as an electric motor for rotating the spindle about its central axis. The spindle that acts as a rotational shaft extending parallel to the Y-axis has a proximal end rotatably housed in the housing 20. The rotary actuator for rotating the spindle is also housed in the housing 20. When the rotary actuator is energized, it rotates the spindle about its central axis. The cutting blade 18 is mounted on a distal end of the spindle. When the spindle is rotated by the rotary actuator, the cutting blade 18 is rotated thereby about its central axis. The cutting blade 18 is an annular grindstone including an annular binder of a metal or resin material and abrasive grains of diamond dispersed and secured in the binder.

When the spindle is rotated, the rotating cutting blade 18 is lowered to a predetermined height, and the processing feed unit is actuated to processing-feed the holding table 14 to bring the annular grindstone of the rotating cutting blade 18 into abrasive contact with the workpiece 1. Then, the cutting blade 18 cuts the workpiece 1 along one of the projected dicing lines 3, forming a processed mark, i.e., a dividing groove, 13 in the workpiece 1. When processed marks 13 are formed in the workpiece 1 along all the projected dicing lines 3, the workpiece 1 is divided into individual device chips.

When the spindle with the cutting blade 18 connected to its distal end rotates, the spindle is heated. The spindle is thermally expanded, possibly causing the cutting blade 18 to fail to process the workpiece 1 to desired standards. In order to keep the spindle at a constant temperature to prevent the spindle from being thermally expanded, the spindle unit 19 is connected to a spindle temperature adjusting unit 48 (see FIG. 4), to be described later, for cooling the spindle unit 19 thereby to adjust the temperature of the spindle to a predetermined temperature. The spindle temperature adjusting unit 48 supplies the spindle unit 19 with a cooling liquid whose temperature is adjusted to a predetermined temperature. The spindle temperature adjusting unit 48 includes a circulation route 50, to be described later, through which a cooling liquid circulates. The circulation route 50 includes a cooling unit 62, to be described later, for cooling the cooling liquid. The housing 20 of the spindle unit 19 is supplied with the cooling liquid from a supply conduit 21*a* of the circulation route 50. The cooling liquid that has been used to cool the spindle in the housing 20 returns through a return conduit 21*b* to the circulation route 50. The cooling liquid that that has returned to the circulation route 50 is cooled by the cooling unit 62 in the circulation route 50 and supplied again to the housing 20.

When the cutting blade 18 cuts the workpiece 1, the annular grindstone and the workpiece 1 produce swarf and heat. While the cutting blade 18 is cutting the workpiece 1, the cutting blade 18 and the workpiece 1 are supplied with a processing liquid, i.e., a cutting liquid, such as pure water to remove the swarf and the heat. The processing liquid keeps the workpiece 1 and the cutting blade 18 at a predetermined temperature. The processing unit 16 further includes a blade cover 22 that covers the cutting blade 18 and a processing liquid supply nozzle 24 coupled to the blade cover 22. A processing liquid ejection nozzle 26 (see FIG. 3) for ejecting the processing liquid to the cutting blade 18 is disposed in the blade cover 22. The processing liquid is supplied from both the processing liquid supply nozzle 24 and the processing liquid ejection nozzle 26 to the cutting blade 18.

FIG. 3 schematically illustrates, in cross section and partly in side elevation, the processing chamber 12 in which the processing unit 16 processes the workpiece 1. The blade cover 22 incorporates a pair of liquid supply conduits 28 having respective terminal ends fluidly connected respectively to the processing liquid supply nozzle 24 and the processing liquid ejection nozzle 26. The liquid supply conduits 28 have respective inlet ends fluidly connected respectively to joints 30 to which there are connected respective conduits 32 of a supply route 64 (see FIG. 4), to be described later, for supplying the processing liquid. The processing liquid is supplied through the supply route 64, the conduits 32, and the liquid supply conduits 28 to the processing liquid supply nozzle 24 and the processing liquid ejection nozzle 26.

A protective cover 34 is disposed closely to and below the opening 12*c* of the processing chamber 12. The protective cover 34 prevents the processing liquid that has been used by the processing unit 16 to process the workpiece 1 from being scattered out of the processing chamber 12 through the opening 12*c*. The processing space 36 defined in the processing chamber 12 is divided into a processing zone 36*a* and a delivery zone 36*b* by a partition 38 that is positioned in front of the processing unit 16, i.e., on the right side of the processing unit 16 in FIG. 3. The workpiece 1 is processed in the processing zone 36*a* by the processing unit 16, whereas the workpiece 1 is loaded from the delivery zone 36*b* onto the holding table 14 and unloaded from the holding table 14 into the delivery zone 36*b*. The partition 38 prevents the processing liquid that has been used by the processing unit 16 to process the workpiece 1 from being scattered into the delivery zone 36*b*. The partition 38 has an opening 38*a* defined in a lower end portion thereof. The holding table 14 is movable along the X-axis through the opening 38*a* between the processing zone 36*a* and the delivery zone 36*b*.

When the workpiece 1 is processed in the processing zone 36*a* by the processing unit 16, the processing liquid, denoted by 40, that is supplied from the supply route 64 and used in processing the workpiece 1 is scattered rearwardly, i.e., leftwardly in FIG. 3, by the cutting blade 18 as it rotates. The scattered processing liquid 40 is discharged through a drain 42 disposed behind the dust-resistant and drip-resistant cover 14*d*. The drain 42 represents a discharge mechanism for discharging the processing liquid 40 used in the processing chamber 12 out of the processing chamber 12. The drain 42 includes a reservoir 42*a* for temporarily storing the processing liquid 40 in the processing space 36 and a conduit 42*b* having an end connected to the bottom of the reservoir 42*a* and an opposite end connected to a discharge channel 74 (see FIG. 4), to be described later. The processing liquid 40 scattered in the processing space 36 is temporarily stored in the reservoir 42*a* and flows through the conduit 42*b* into the discharge channel 74.

The processing apparatus 2 may include a cleaning unit, not illustrated, for cleaning the workpiece 1 that has been processed. The cleaning unit includes a rotatable spinner table for holding the workpiece 1 and an ejection unit for ejecting cleaning water to the workpiece 1 held on the spinner table. After the processed workpiece 1 has been cleaned by the cleaning unit, the workpiece 1 is unloaded from the processing apparatus 2.

The processing apparatus 2 includes a controller, i.e., a control unit, 44 for controlling various components including the holding table 14, the processing unit 16, the cleaning unit, etc. The controller 44 also controls the cassette support table 8, the X-axis moving mechanism, the Y-axis moving mechanism, and the Z-axis moving mechanism. The controller 44 may also control components disposed in the supply route 64 that supplies the processing liquid to the processing unit 16 and the workpiece 1 and in the circulation route 50 that circulates the cooling liquid through the processing unit 16. The controller 44 is electrically connected to the respective components. The controller 44 is constituted by, for example, a computer including a processor such as a central processing unit (CPU), a main storage unit such as a dynamic random access memory (DRAM), and an auxiliary storage unit such as a flash memory. The controller 44 has its functions performed by operating the processor, etc., according to software, i.e., programs, stored in the auxiliary storage unit.

A processing liquid supply source for supplying the processing liquid 40 to the processing unit 16 is connected to the processing apparatus 2. The temperature of the processing liquid 40 supplied from the processing liquid supply source may extremely be low depending on the geographic region in which the processing apparatus 2 is used, the facility of the factory in which the processing apparatus 2 is installed, or the environment around the processing apparatus 2. If the processing liquid whose temperature is extremely low is supplied to the cutting blade 18 and the workpiece 1, then the cutting blade 18 and the workpiece 1 are caused to suffer thermal shrinkage. Heretofore, one solution has been to incorporate a heating unit such as a heater in the supply route 64 to heat the processing liquid 40 supplied from the processing liquid supply source to a desired temperature. However, it is highly costly to install and operate the heating unit. In addition, the processing apparatus 2 makes its efficiency low by using the cooling unit to reuse the cooling liquid that has been used, and while at the same time heating the processing liquid 40 supplied from the processing liquid supply source before the processing liquid 40 is ejected to the workpiece 1 and the cutting blade 18.

The processing apparatus 2 according to the present embodiment is arranged to efficiently supply the cooling liquid at a predetermined temperature to predetermined components including the processing unit 16, etc. The processing apparatus 2 according to the present embodiment will be described below primarily with respect to the circulation route 50 for efficiently supplying the cooling liquid at a predetermined temperature to the processing unit 16, etc., to cool the processing unit 16 and the supply route 64 for efficiently supplying the processing liquid 40 at a predetermined temperature to the processing unit 16, etc.

Figure 4:
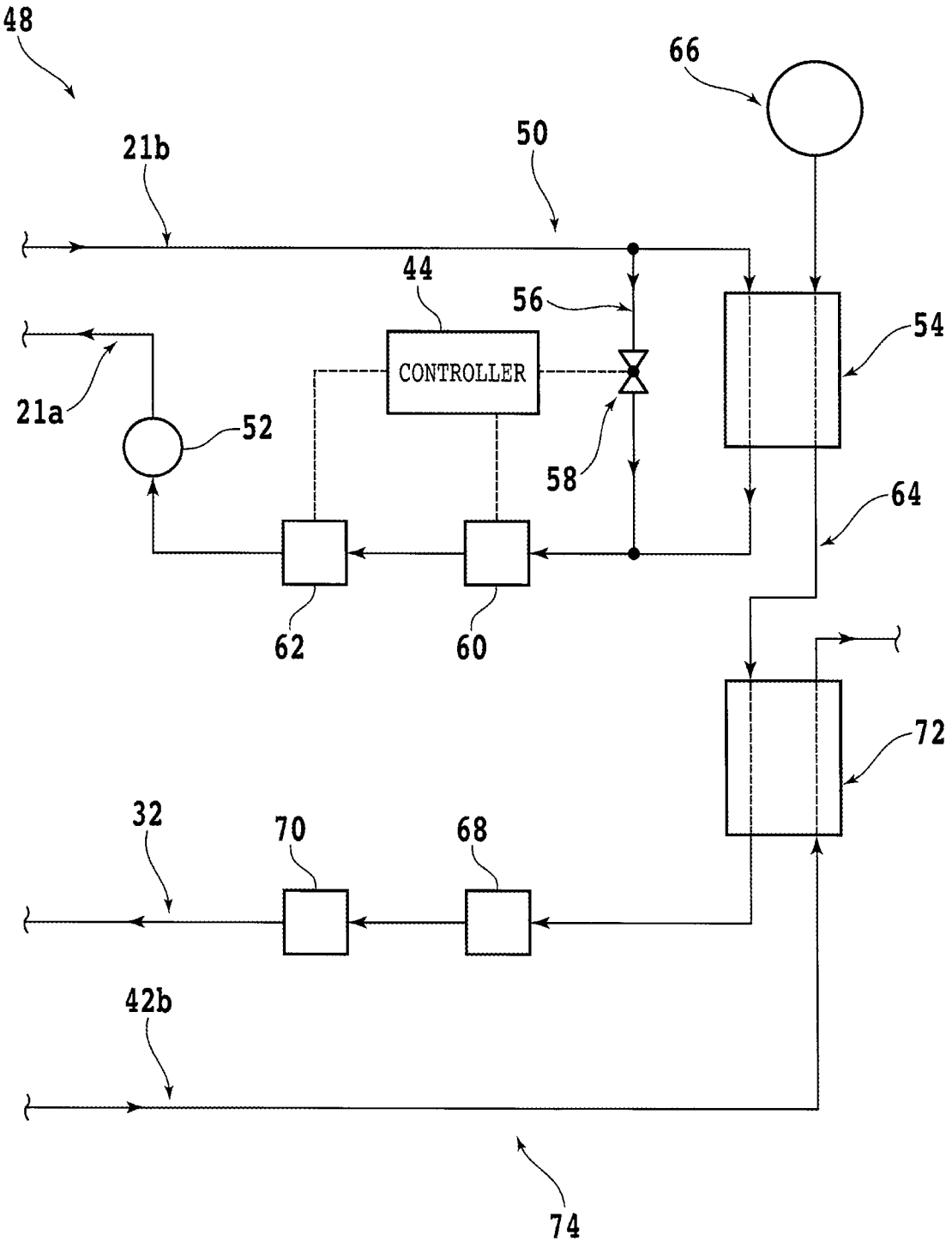
FIG. 4 is a block diagram schematically illustrating a connection layout of a circulation route for circulating a cooling liquid and a supply route for supplying a processing liquid.

FIG. 4 schematically illustrates a connection layout of the spindle temperature adjusting unit 48 for supplying the cooling liquid to the spindle unit 19 of the processing unit 16 to adjust the temperature of the spindle of the spindle unit 19. In FIG. 4, the respective components are illustrated as blocks and symbols and interconnected by conduits illustrated as lines. The conduits are tubes, pipes, or the like made of resin, for example.

The spindle temperature adjusting unit 48 includes the circulation route 50 through which there circulates the cooling liquid to be introduced into the housing 20 of the spindle unit 19 and discharged from the housing 20. The spindle temperature adjusting unit 48 also includes a pump 52 connected to the circulation route 50 to circulate the cooling liquid through the circulation route 50 and a first heat exchanger 54 connected to the circulation route 50. The spindle temperature adjusting unit 48 further includes a first temperature sensor 60 connected to the circulation route 50 upstream of the housing 20 of the spindle unit 19 to measure the temperature of the cooling liquid as it flows into the housing 20. The cooling unit 62 for cooling the cooling liquid is connected to the circulation route 50. In FIG. 4, the cooling unit 62 is illustrated as being positioned downstream of the first temperature sensor 60. However, the cooling unit 62 may be positioned upstream of the first temperature sensor 60.

The pump 52 is not limited to any particular type. The pump 52 may be a non-positive-displacement pump such as a centrifugal pump or a propeller pump, or a displacement pump such as a reciprocating pump or a rotary pump. The first temperature sensor 60, which is not limited to any particular type, may be a resistance temperature detector, a thermocouple, or a contact-type temperature sensor incorporating an IC temperature sensor. The cooling unit 62, which is not limited to any particular type either, may be an air-cooled or liquid-cooled heat exchanger. The cooling unit 62 performs a heat exchange between a cooling medium supplied from the factory where the processing apparatus 2 is installed, etc., and the cooling liquid flowing through the circulation route 50, for example. Alternatively, the cooling unit 62 may be a cooling device such as a Peltier device. The first heat exchanger 54 is not limited to any particular type either. For example, the first heat exchanger 54 may be a tube-type heat exchanger or a plate-type heat exchanger.

The supply route 64 for supplying the processing liquid 40 to the processing unit 16 is connected to the first heat exchanger 54 that is connected to the circulation route 50 of the spindle temperature adjusting unit 48. The supply route 64 has its inlet end connected to a processing liquid supply source 66. For example, the processing liquid supply source 66 is a tank, which is a facility of the factory where the processing apparatus 2 is installed, etc., for supplying the processing liquid 40 such as pure water. The processing liquid 40 may be mixed in advance with an additive such as a surfactant.

The cooling liquid that flows through the return conduit 21*b* of the circulation route 50 has its temperature increased because the cooling liquid has been used to cool the spindle of the spindle unit 19. Therefore, the cooling liquid flowing through the return conduit 21*b* cannot be used again as it is to cool the spindle of the spindle unit 19. On the other hand, since the temperature of the processing liquid 40 supplied from the processing liquid supply source 66 is low, the processing liquid 40 from the processing liquid supply source 66 cannot be supplied as it is to the processing unit 16. Both the circulation route 50 of the spindle temperature adjusting unit 48 and the supply route 64 for supplying the processing liquid 40 go through the first heat exchanger 54. Therefore, the first heat exchanger 54 performs a heat exchange between the cooling liquid used to cool the spindle of the spindle unit 19 and flowing through the return conduit 21*b* of the circulation route 50 and the processing liquid 40 supplied from the processing liquid supply source 66 and flowing through the supply route 64. In other words, in the first heat exchanger 54, the temperature of the cooling liquid used to cool the spindle of the spindle unit 19 and flowing through the circulation route 50 is lowered by the processing liquid 40, and the temperature of the processing liquid 40 is raised by the cooling liquid. Therefore, the cooling liquid has its temperature becoming closer to a temperature suitable for being used again to cool the spindle of the spindle unit 19, whereas the processing liquid 40 has its temperature becoming closer to a temperature suitable for being supplied to the processing unit 16.

The spindle temperature adjusting unit 48 will be described below from a different perspective. The first heat exchanger 54 is connected to the circulation route 50 at an intermediate point thereof and is supplied with the cooling liquid that has been used to cool the spindle of the spindle unit 19 via the circulation route 50. The cooling liquid discharged from the first heat exchanger 54 after having exchanged heat with the processing liquid 40 flows from the first heat exchanger 54 again through the circulation route 50 downstream of the first heat exchanger 54. The first heat exchanger 54 is connected to the supply route 64 at an intermediate point thereof and is supplied with the processing liquid 40 from the processing liquid supply source 66 via the supply route 64. The processing liquid 40 discharged from the first heat exchanger 54 after having exchanged heat with the cooling liquid flows from the first heat exchanger 54 again through the supply route 64 downstream of the first heat exchanger 54.

In the absence of the first heat exchanger 54 connected to the circulation route 50, the temperature of the cooling liquid needs to be lowered mainly by the cooling unit 62, which incurs a high operating cost. According to the present embodiment, however, since the first heat exchanger 54 is connected to the circulation route 50 and also lowers the temperature of the cooling liquid, the first heat exchanger 54 is effective to lower the operation intensity of the cooling unit 62 for regulating the temperature of the cooling liquid. Further, if the temperature of the cooling liquid is sufficiently lowered by the first heat exchanger 54, then the cooling unit 62 may be left out of service. The temperature of the cooling liquid that is lowered by the first heat exchanger 54 is monitored by the first temperature sensor 60. In order to supply the spindle unit 19 with the cooling liquid at an optimum temperature, the temperature of the cooling liquid discharged from the first heat exchanger 54 may be measured by the first temperature sensor 60, and the operation intensity of the cooling unit 62 may be determined depending on the measured temperature of the cooling liquid. In particular, the first temperature sensor 60 and the cooling unit 62 should electrically be connected to the controller 44, and it is preferable for the controller 44 to determine an output level for the cooling unit 62 by referring to the temperature of the cooling liquid measured by the first temperature sensor 60 and control the cooling unit 62 on the basis of the determined output level.

When the temperature of the cooling liquid discharged from the first heat exchanger 54 and flowing again through the circulation route 50 downstream of the first heat exchanger 54 is measured by the first temperature sensor 60, the measured temperature of the cooling liquid may be lower than an optimum temperature for cooling the spindle of the spindle unit 19. In other words, the first heat exchanger 54 may excessively cool the cooling liquid to the extent that it is not suitable to supply the cooling liquid discharged from the first heat exchanger 54 to the spindle unit 19. To overcome this drawback, the spindle temperature adjusting unit 48 includes a bypass route 56 connected to the circulation route 50 parallel to the first heat exchanger 54. The bypass route 56 includes a valve 58 for adjusting the rate at which the cooling liquid flows through the bypass route 56. The valve 58 may be of any type capable of adjusting the rate at which the cooling liquid flows through the bypass route 56, and may be an electronically controllable valve incorporating a globe valve, a gate valve, a ball valve, a butterfly valve, or the like.

The bypass route 56 with the valve 58 being open prevents the cooling liquid that has been used to cool the spindle of the spindle unit 19 and that flows through the circulation route 50 from being introduced wholly into the first heat exchanger 54, but allows part of the cooling liquid to flow through the bypass route 56 in bypassing relation to the first heat exchanger 54. The cooling liquid flowing through the bypass route 56 and not lowered in temperature by the first heat exchanger 54 joins the cooling liquid whose temperature has been lowered by the first heat exchanger 54, and flows again through the circulation route 50 downstream of the first heat exchanger 54. At this time, the temperature of the cooling liquid measured by the first temperature sensor 60 is higher than that if the cooling liquid that has been used to cool the spindle of the spindle unit 19 and that flows through the circulation route 50 is introduced wholly into the first heat exchanger 54. By controlling the valve 58 to adjust the rate at which the cooling liquid flows through the bypass route 56, the controller 44 can adjust the reduction in the temperature of the cooling liquid immediately after the cooling liquid has been used to cool the spindle of the spindle unit 19 until the cooling liquid enters the first temperature sensor 60. In other words, the spindle temperature adjusting unit 48 that includes the bypass route 56 and the valve 58 is able to prevent the cooling liquid from being overcooled by the first heat exchanger 54.

The degree of opening of the valve 58 may be adjusted by the controller 44. Stated otherwise, the controller 44 may adjust the degree of opening of the valve 58 by referring to the temperature of the cooling liquid measured by the first temperature sensor 60. The controller 44 may control the bypass route 56 and the cooling unit 62 to function simultaneously, e.g., to set the valve 58 to a non-zero degree of opening and to operate the cooling unit 62 for a non-zero output level. In other words, even if the first heat exchanger 54 is able to cool the cooling liquid sufficiently and the cooling unit 62 does not need to be in operation, the cooling liquid may be cooled by both the first heat exchanger 54 and the cooling unit 62. In this case, even if the first heat exchanger 54 fails to stabilize the reduction in the temperature of the cooling liquid, the controller 44 may control the cooling unit 62 to achieve a finely tuned output level, thereby causing the temperature of the cooling liquid to match a desired predetermined temperature accurately.

The supply route 64 included in the processing apparatus 2 will be described below. The processing liquid 40 supplied at a low temperature from the processing liquid supply source 66 flows in the supply route 64. The processing liquid 40 is introduced into the first heat exchanger 54 that increases the temperature of the processing liquid 40. The processing liquid 40 whose temperature has been increased by the first heat exchanger 54 is discharged from the first heat exchanger 54 and flows through the supply route 64 into the conduits 32. Providing the temperature of the processing liquid 40 has been increased to a predetermined temperature suitable for processing the workpiece 1, the processing liquid 40 is supplied from the liquid supply conduits 28, the processing liquid supply nozzle 24, and the processing liquid ejection nozzle 26 to the workpiece 1 on the holding table 14 and the cutting blade 18. If the processing liquid 40 that is supplied from the processing liquid supply source 66 to the first heat exchanger 54 and that has its temperature raised by the first heat exchanger 54 has not reached the predetermined temperature suitable for processing the workpiece 1, then it is necessary to further heat the processing liquid 40 before the processing liquid 40 is supplied to the workpiece 1 and the cutting blade 18. It is therefore preferable for the supply route 64 to include a heating unit 68 for heating the processing liquid 40 that flows in the supply route 64 and a second temperature sensor 70 for measuring the temperature of the processing liquid 40 that flows in the supply route 64 downstream of the heating unit 68.

The second temperature sensor 70 should preferably be structurally identical to the first temperature sensor 60. The heating unit 68 may include an electrically heated wire, for example. Alternatively, the heating unit 68 may be a heat exchanger for performing a heat exchange between a heating medium supplied from the factory where the processing apparatus 2 is installed, etc., and the processing liquid 40. However, the second temperature sensor 70 and the heating unit 68 may not necessarily be limited to those described above. The controller 44 may electrically be connected to the second temperature sensor 70 and the heating unit 68. The controller 44 may adjust the output level of the heating unit 68 by referring to the temperature of the processing liquid 40 measured by the second temperature sensor 70, to cause the processing liquid 40 to attain an optimum temperature at the time when the processing liquid 40 is supplied to the workpiece 1 and the cutting blade 18.

In the absence of the first heat exchanger 54 connected to the supply route 64, the processing liquid 40 supplied from the processing liquid supply source 66 has to be heated only by the heating unit 68 to regulate its temperature. By contrast, in the presence of the first heat exchanger 54 connected to the supply route 64, the temperature of the processing liquid 40 is increased by the first heat exchanger 54, making the operation intensity of the heating unit 68 relatively low. Therefore, the processing apparatus 2 according to the present embodiment that includes the first heat exchanger 54 is also able to efficiently adjust the temperature of the processing liquid 40.

As illustrated in FIG. 4, the supply route 64 for supplying the processing liquid 40 may include a second heat exchanger 72. The second heat exchanger 72 is supplied with the processing liquid 40 from the processing liquid supply source 66 and also with the used processing liquid 40 that has been supplied to the workpiece 1 on the holding table 14 and the cutting blade 18 via the supply route 64. The used processing liquid 40 that has been supplied to the workpiece 1 on the holding table 14 and the cutting blade 18 via the supply route 64 has its temperature increased because it contains swarf produced from the workpiece 1 as it is processed and the heat generated by the cutting blade 18 processing the workpiece 1. The processing liquid 40 at the increased temperature is discharged from the processing apparatus 2 via the conduit 42*b* illustrated in FIG. 3. The processing apparatus 2 according to the present embodiment uses the heat of the discharged processing liquid 40 to heat the processing liquid 40 to be supplied to the workpiece 1 and the cutting blade 18 in the second heat exchanger 72.

The second heat exchanger 72 is connected to the discharge channel 74 that discharges the used processing liquid 40. The second heat exchanger 72 may structurally be identical to the first heat exchanger 54. The second heat exchanger 72 increases the temperature of the processing liquid 40 supplied from the processing liquid supply source 66, with the used processing liquid 40 from the discharge channel 74. Since the processing liquid 40 supplied from the processing liquid supply source 66 is heated by the first heat exchanger 54 and also the second heat exchanger 72 to increase its temperature, the operation intensity of the heating unit 68 may be lower. Consequently, the processing apparatus 2 according to the present embodiment that includes the first heat exchanger 54 and the second heat exchanger 72 is able to further efficiently adjust the temperature of the processing liquid 40.

The circulation route 50 and the supply route 64 that have the respective temperature sensors 60 and 70 have been described above. However, the processing apparatus 2 according to the present embodiment is not limited to the details described above. The processing apparatus 2 according to the present embodiment may include other temperature sensors connected respectively to the circulation route 50 and the supply route 64 and may also include tanks for temporarily storing the cooling liquid and the processing liquid 40, respectively, and pumps for discharging the cooling liquid and the processing liquid 40 from the tanks. The controller 44 may control components including the cooling unit 62, the heating unit 68, etc., and may also control the degree of opening of the valve 58 and the output levels of the pumps by referring to the temperatures of the cooling liquid and the processing liquid 40 measured by the other temperature sensors. Measuring the temperatures of the cooling liquid and the processing liquid 40 at various locations in the circulation route 50 and the supply route 64 with the many temperature sensors allows the controller 44 to control the components in a finer fashion and control the temperatures of the cooling liquid and the processing liquid 40 more accurately.

As described above, in the processing apparatus 2 according to the present embodiment, the cooling liquid circulating through the circulation route 50 for use in cooling the spindle of the spindle unit 19 is cooled by the processing liquid 40 supplied at a low temperature from the processing liquid supply source 66. Since the cooling liquid that has been used and thus has its temperature increased is efficiently cooled, the processing apparatus 2 according to the present embodiment is able to efficiently supply the cooling liquid at the predetermined temperature to the components to be cooled. In the processing apparatus 2 according to the present embodiment, further, the processing liquid 40 supplied through the supply route 64 to the workpiece 1 and the cutting blade 18 is heated by the cooling liquid that has been used to cool the spindle of the spindle unit 19. Since the processing liquid 40 is efficiently heated to a predetermined temperature, the processing apparatus 2 according to the present embodiment is able to efficiently supply the processing liquid 40 at the predetermined temperature to the components involved in processing the workpiece 1.

Figure 5:
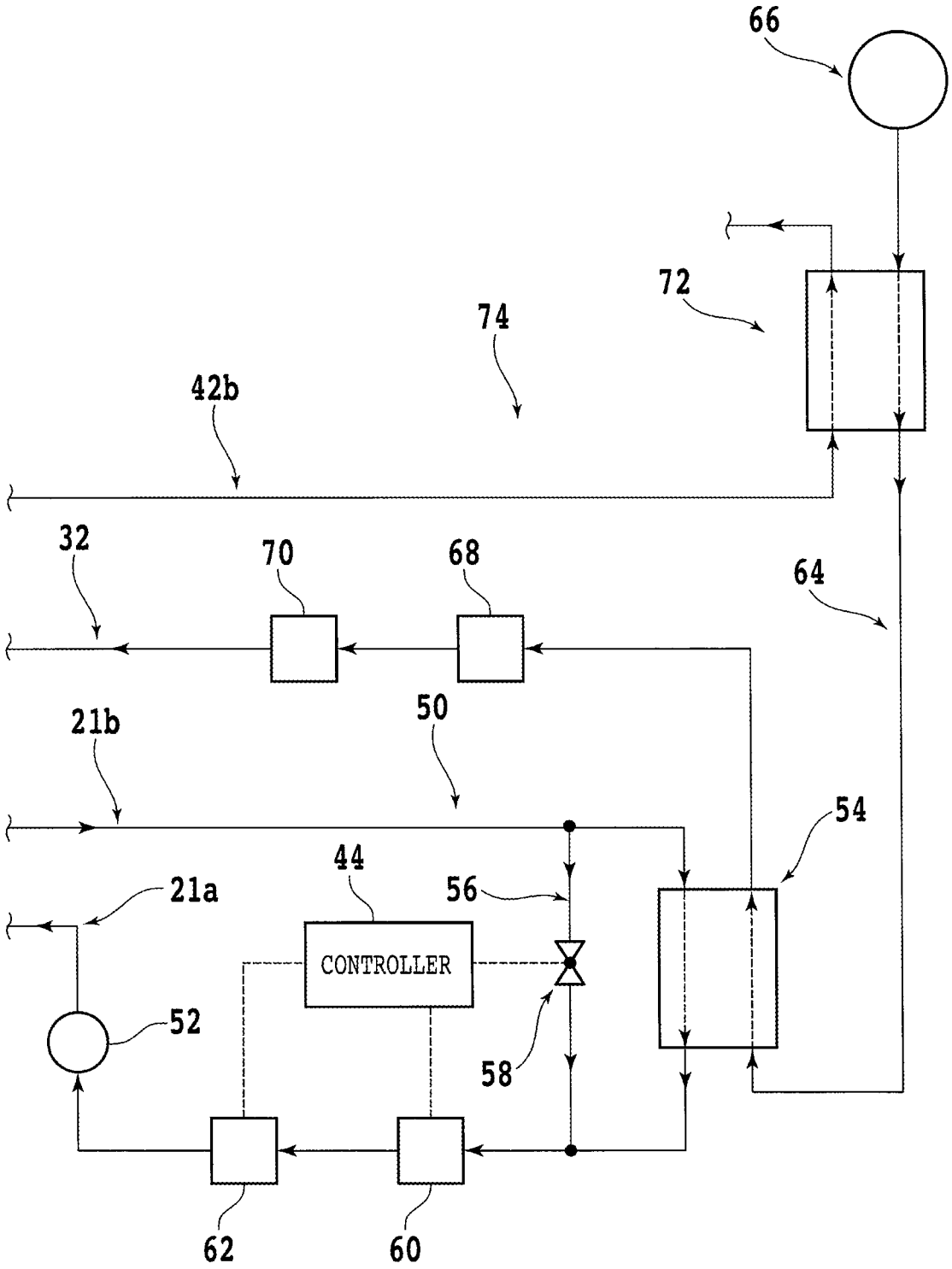
FIG. 5 is a block diagram schematically illustrating another connection layout of a circulation route for circulating a cooling liquid and a supply route for supplying a processing liquid according to a modification of the embodiment.

The present invention is not limited to the details described according to the above embodiment, and various changes and modifications may be made therein. According to the above embodiment, for example, the processing liquid 40 supplied from the processing liquid supply source 66 to the supply route 64 flows initially through the first heat exchanger 54 and then through the second heat exchanger 72, as illustrated in FIG. 4. However, the present invention is not limited to such details. According to a modification of the above embodiment, the processing liquid 40 supplied from the processing liquid supply source 66 to the supply route 64 may flow initially through the second heat exchanger 72 and then through the first heat exchanger 54. FIG. 5 schematically illustrates, in block form, another connection layout of a circulation route for circulating a cooling liquid and a supply route for supplying a processing liquid according to the modification of the embodiment.

According to the modification illustrated in FIG. 5, the processing liquid 40 supplied from the processing liquid supply source 66 to the supply route 64 reaches the first heat exchanger 54 while being kept at a temperature higher than that in a case of the first heat exchanger 54 illustrated in FIG. 1. Therefore, the difference between the temperature of the cooling liquid flowing in the circulation route 50 and reaching the first heat exchanger 54 and the temperature of the processing liquid 40 flowing in the supply route 64 and reaching the first heat exchanger 54 is relatively small. Therefore, the amount of heat exchanged between the processing liquid 40 and the cooling liquid in the first heat exchanger 54 is reduced, resulting in a reduction in the drop of the temperature of the cooling liquid in the first heat exchanger 54.

For example, if the temperature of the processing liquid 40 supplied from the processing liquid supply source 66 to the supply route 64 is extremely low, then, when the processing liquid 40 initially passes through the first heat exchanger 54, the temperature of the cooling liquid with which heat is exchanged by the first heat exchanger 54 may become excessively low. At this time, in order to prevent the cooling liquid from being cooled excessively, the valve 58 is widely opened to increase the rate at which the cooling liquid flows through the bypass route 56. With the valve 58 being widely opened, the margin available for adjusting the rate at which the cooling liquid flows through the bypass route 56 by opening and closing the valve 58 may be reduced. By contrast, providing the difference between the temperatures of the cooling liquid and the processing liquid 40 that have reached the first heat exchanger 54 is relatively small, the valve 58 does not need to be widely opened from the outset. Therefore, the margin available for adjusting the rate at which the cooling liquid flows through the bypass route 56 with the valve 58 is increased. Consequently, the modification illustrated in FIG. 5 in which the processing liquid 40 supplied from the processing liquid supply source 66 to the supply route 64 initially passes the second heat exchanger 72 is beneficial in certain situations to the adjustment of the temperature of the cooling liquid.

According to the above embodiment, the temperature of the processing liquid 40 supplied from the processing liquid supply source 66 has its temperature increased by passing through both the first heat exchanger 54 and the second heat exchanger 72. The processing apparatus 2 according to the present invention is not limited to such details. The processing liquid 40 supplied from the processing liquid supply source 66 may not flow through one of the first heat exchanger 54 and the second heat exchanger 72. For example, the processing liquid 40 supplied as unused from the processing liquid supply source 66 may have its temperature increased by a heat exchange only in the second heat exchanger 72.

The details of a processing apparatus according to the latter modification will be described below. The processing apparatus, also denoted by 2, includes the supply route 64 through which the processing liquid 40 supplied from the processing liquid supply source 66 flows to the workpiece 1 on the holding table 14 and the cutting blade 18, and a heat exchanger, i.e., the second heat exchanger 72, connected to the supply route 64. In the processing apparatus 2, the used processing liquid 40 that has been supplied to the workpiece 1 on the holding table 14 and the cutting blade 18 through the supply route 64 is introduced into the heat exchanger. In the heat exchanger, the temperature of the processing liquid 40 flowing through the supply route 64 is increased by the used processing liquid 40.

The supply route 64 may include a heating unit 68 for heating the processing liquid 40 that flows in the supply route 64 and a temperature sensor, i.e., the second temperature sensor 70, for measuring the temperature of the processing liquid 40 that flows in the supply route 64 downstream of the heating unit 68 and the heat exchanger. In the processing apparatus 2, the temperature of the processing liquid 40 to be used that is to be supplied to the workpiece 1 and the cutting blade 18 is increased by the processing liquid 40 that has been used. Therefore, the operation intensity of the heating unit 68 is restrained compared with an arrangement in which no heat exchanger is connected to the supply route 64.

According to the above embodiment, the temperature of the processing liquid 40 supplied from the processing liquid supply source 66 is too low to use the processing liquid 40. The present invention is not limited to such details. Depending on the geographic region in which the processing apparatus 2 is installed, the temperature of the processing liquid 40 supplied from the processing liquid supply source 66 may extremely be high, so that the processing liquid 40 cannot be used as it is.

In such a case, the processing liquid 40 whose temperature is high and that is supplied from the processing liquid supply source 66 does not need to pass through the first heat exchanger 54. On the other hand, it is significant that the processing liquid 40 whose temperature is high passes only through the second heat exchanger 72. Inasmuch as the temperature of the processing liquid 40 that has been supplied to the workpiece 1 and the cutting blade 18 and has been used is lower than the temperature of the processing liquid 40 to be used, the temperature of the processing liquid 40 to be used is lowered by a heat exchange in the second heat exchanger 72.

If it is assumed that the temperature of the processing liquid 40 supplied from the processing liquid supply source 66 is high, then it is desirable that the supply route 64 include a cooling unit, not illustrated, instead of or in addition to the heating unit 68. When the temperature of the processing liquid 40 to be used is lowered by the second heat exchanger 72, the operation intensity of the cooling unit is restrained.

In summary, it is significant that the processing liquid 40 to be used passes through the heat exchanger, i.e., the second heat exchanger 72, through which the used processing liquid 40 has passed, if the temperature of the processing liquid 40 to be used that is supplied from the processing liquid supply source 66 and that flows in the supply route 64 is low or high. At any rate, since the temperature of the processing liquid 40 to be used becomes closer to the temperature of the used processing liquid 40, the temperature of the processing liquid 40 to be used becomes closer to a temperature suitable for using the processing liquid 40. Consequently, the operation intensity of the heating unit 68 or the cooling unit connected to the supply route 64 is retrained.

According to the above embodiment, the controller 44 for controlling the components of the processing apparatus 2 is electrically connected to the cooling unit 62, the first temperature sensor 60, the valve 58, the heating unit 68, and the second temperature sensor 70, and the controller 44 adjusts the output levels of the cooling unit 62 and the heating unit 68 and adjusts the degree of opening of the valve 58. However, the processing apparatus 2 according to the present invention is not limited to such details. The processing apparatus 2 according to the present invention may include, as a controller, a dedicated control unit that functions only to control the cooling unit 62, the valve 58, and the heating unit 68. The dedicated control unit may be electrically connected to the cooling unit 62, the first temperature sensor 60, the valve 58, the heating unit 68, and the second temperature sensor 70. The dedicated control unit may not control the other components of the processing apparatus 2. In other words, the controller of the processing apparatus 2 according to the present invention is not limited to any configurations and functions.

The processing apparatus 2 according to the present invention may issue a warning to the operator or the like if the temperature of the cooling liquid measured by the first temperature sensor 60 or the temperature of the processing liquid 40 measured by the second temperature sensor 70 deviates widely from a predetermined temperature suitable for using the cooling liquid or the processing liquid 40. This is because, when the temperatures of the cooling liquid and the processing liquid 40 deviate widely from respective predetermined temperatures and it is expected that the temperatures cannot sufficiently be adjusted by using the cooling unit 62, the heating unit 68, etc., the processing apparatus 2 cannot process the workpiece 1 to desired standards. At this time, the controller may control the processing unit 16 to stop processing the workpiece 1. The controller may control the warning lamp unit 46 to turn on a red lamp issuing a warning. Alternatively, the controller may control the display 10 with the touch panel to display a warning screen. The processing apparatus 2 is thus prevented from unduly processing the workpiece 1.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A processing apparatus including a holding table for holding a workpiece thereon, a processing unit for processing the workpiece held on the holding table, and a controller, wherein wherein:

the processing unit includes a spindle unit having a spindle with a processing tool mounted thereon, a housing in which the spindle is rotatably supported, and an electric motor for rotating the spindle about its central axis, the processing apparatus further includes a spindle temperature adjusting unit for cooling the spindle of the spindle unit to adjust a temperature of the spindle to a predetermined temperature, the processing unit being connected to the spindle temperature adjusting unit, wherein the spindle temperature adjusting unit includes:

a circulation route through which a cooling liquid to be introduced into the housing of the spindle unit and discharged from the housing circulates, a pump connected to the circulation route and configured to circulate the cooling liquid through the circulation route, a first heat exchanger connected to the circulation route, and a first temperature sensor connected to the circulation route upstream of the housing and configured to measure a temperature of the cooling liquid that is to flow into the housing, and wherein the first heat exchanger is supplied with a processing liquid supplied from a processing liquid supply source, whereby the processing liquid exchanges heat with the cooling liquid to thereby lower the temperature of the cooling liquid flowing in the circulation route and the cooling liquid exchanges heat with the processing liquid to thereby increase a temperature of the processing liquid, such that the cooling liquid discharged from the first heat exchanger is of a lower temperature than the cooling liquid that entered the first heat exchanger and the processing liquid discharged from the first heat exchanger is of a higher temperature than the processing liquid that entered the first heat exchanger; and wherein the first heat exchanger comprises a tube-type heat exchanger or a plate-type heat exchanger.

2. The processing apparatus according to claim 1, wherein:

the spindle temperature adjusting unit further includes a cooling unit connected to the circulation route and configured to cool the cooling liquid, and the controller adjusts an output level of the cooling unit by referring to the temperature of the cooling liquid measured by the first temperature sensor.

3. The processing apparatus according to claim 1, wherein the spindle temperature adjusting unit further includes:

a bypass route connected to the circulation route parallel to the first heat exchanger, and a valve connected to the bypass route and configured to adjust a rate at which the cooling liquid flows in the bypass route, and the controller adjusts a degree of opening of the valve by referring to the temperature of the cooling liquid measured by the first temperature sensor.

4. The processing apparatus according to claim 2, wherein the spindle temperature adjusting unit further includes:

a bypass route connected to the circulation route parallel to the first heat exchanger, and a valve connected to the bypass route and configured to adjust a rate at which the cooling liquid flows in the bypass route, and wherein the controller adjusts a degree of opening of the valve by referring to the temperature of the cooling liquid measured by the first temperature sensor.

5. The processing apparatus according to claim 1, further comprising:

a supply route in which the processing liquid flows from the first heat exchanger, wherein the processing liquid that is supplied from the processing liquid supply source to the first heat exchanger and that has a temperature increased by the first heat exchanger is supplied through the supply route to the workpiece held on the holding table or the processing tool.

6. The processing apparatus according to claim 5, further comprising:

a heating unit connected to the supply route and configured to heat the processing liquid flowing in the supply route; and a second temperature sensor connected to the supply route downstream of the heating unit and configured to measure the temperature of the processing liquid flowing in the supply route.

7. The processing apparatus according to claim 5, further comprising:

a second heat exchanger connected to the supply route, wherein the processing liquid that has been supplied to the workpiece held on the holding table or the processing tool through the supply route and that has been used is introduced into the second heat exchanger, and wherein the second heat exchanger increases the temperature of the processing liquid flowing in the supply route with the used processing liquid.

8. A processing apparatus including a holding table for holding a workpiece thereon, a processing unit for processing the workpiece held on the holding table, and a controller, wherein:

the processing unit includes a spindle unit having a spindle with a processing tool mounted thereon, a housing in which the spindle is rotatably supported, and an electric motor for rotating the spindle about its central axis, the processing apparatus further includes a spindle temperature adjusting unit for cooling the spindle of the spindle unit to adjust a temperature of the spindle to a predetermined temperature, the processing unit being connected to the spindle temperature adjusting unit, wherein the spindle temperature adjusting unit includes:

a circulation route through which a cooling liquid to be introduced into the housing of the spindle unit and discharged from the housing circulates, a pump connected to the circulation route and configured to circulate the cooling liquid through the circulation route, a first heat exchanger connected to the circulation route, and a first temperature sensor connected to the circulation route upstream of the housing and configured to measure a temperature of the cooling liquid that is to flow into the housing, and wherein the first heat exchanger is supplied with a processing liquid supplied from a processing liquid supply source, to lower the temperature of the cooling liquid flowing in the circulation route with the processing liquid and increase a temperature of the processing liquid with the cooling liquid, wherein the processing apparatus further comprises:

a supply route in which the processing liquid flows from the first heat exchanger, wherein the processing liquid that is supplied from the processing liquid supply source to the first heat exchanger and that has a temperature increased by the first heat exchanger is supplied through the supply route to the workpiece held on the holding table or the processing tool, and a second heat exchanger connected to the supply route, wherein the processing liquid that has been supplied to the workpiece held on the holding table or the processing tool through the supply route and that has been used is introduced into the second heat exchanger, and wherein the second heat exchanger increases the temperature of the processing liquid flowing in the supply route with the used processing liquid.

9. The processing apparatus according to claim 8, wherein the first heat exchanger comprises a tube-type heat exchanger.

10. The processing apparatus according to claim 8, wherein the first heat exchanger comprises a plate-type heat exchanger.

* * * * *